US005249797A

United States Patent [19]

Dowhy

[11] Patent Number: 5,249,797

[45] Date of Patent: Oct. 5, 1993

[54] HOCKEY TRAINING APPARATUS

[76] Inventor: Wilfred P. Dowhy, 146 Pilgrim Avenue, Winnipeg, Manitoba R2M 0L6, Canada

[21] Appl. No.: 23,634

[22] Filed: Feb. 26, 1993

[51] Int. Cl.[5] ..... A63B 69/00; A63B 59/12

[52] U.S. Cl. ..... 273/57.2; 273/67 A; 273/128 R; 273/80 R

[58] Field of Search ..... 273/57.2, 85 R, 85 B, 273/371, 128 R, 80 R, 80 D, 67 A

[56] References Cited

U.S. PATENT DOCUMENTS

| | | | |
|---|---|---|---|
| 1,541,674 | 6/1925 | Wever | 273/80 D |
| 1,918,447 | 7/1933 | Blatz | 273/80 R X |
| 2,998,251 | 8/1961 | McShane | 273/128 R |
| 3,709,489 | 1/1973 | Holleran et al. | 273/57.2 |
| 3,765,675 | 10/1973 | DiMarzio | 273/57.2 |
| 3,794,318 | 2/1974 | Holmes | 273/57.2 |
| 4,480,833 | 11/1984 | Barcelow et al. | 273/85 B |
| 4,560,163 | 12/1985 | Erickson | 273/85 R |
| 4,872,679 | 10/1989 | Bohaski | 273/128 R X |
| 4,927,145 | 5/1990 | Davis | 273/371 X |
| 5,161,799 | 11/1992 | Nandra | 273/57.2 |

*Primary Examiner*—Paul E. Shapiro
*Attorney, Agent, or Firm*—S. Michael Bender

[57] ABSTRACT

A hockey training aid and game apparatus includes a portable housing having a base unit and a cover connected to the base unit. The base unit includes a floor and four side walls. The floor contains indicia representing a hockey rink; and the cover includes brackets for retaining a collapsible hockey stick and a scoring and control assembly when the apparatus is transported. The stick is capable of being assembled into a functional hockey stick when the apparatus of the invention is used. A first sensor assembly is used for monitoring accurate puck handling. A scoring and control assembly is provided for scoring puck handling and includes a first counter assembly for counting monitored instances of accurate puck handling. A timer shuts off the first counter assembly after a predetermined time expires. A second sensor assembly may be employed for monitoring inaccurate puck handling. In this respect, the scoring and control assembly further includes a second counter assembly for counting monitored instances of inaccurate puck handling. The second counter assembly is also shut off by the timer after a predetermined time expires. A sounding device can sound when inaccurate puck handling is sensed by the second sensor assembly. The first sensor assembly, for measuring puck handling accuracy, includes a first puck sensor located in a center of the floor. The second sensor assembly, for measuring puck handling inaccuracy, can include a number of second puck sensors, or a ribbon of sensors, located along lines near side walls in the floor.

11 Claims, 5 Drawing Sheets

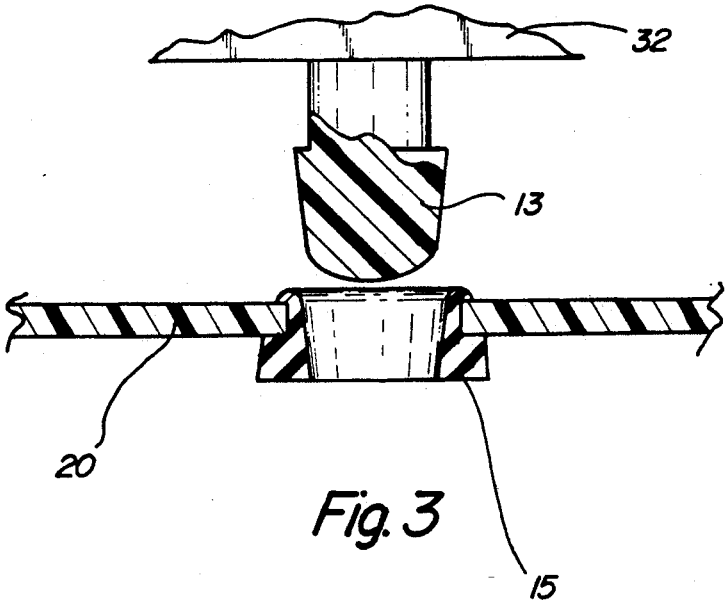
Fig. 3
Fig. 4
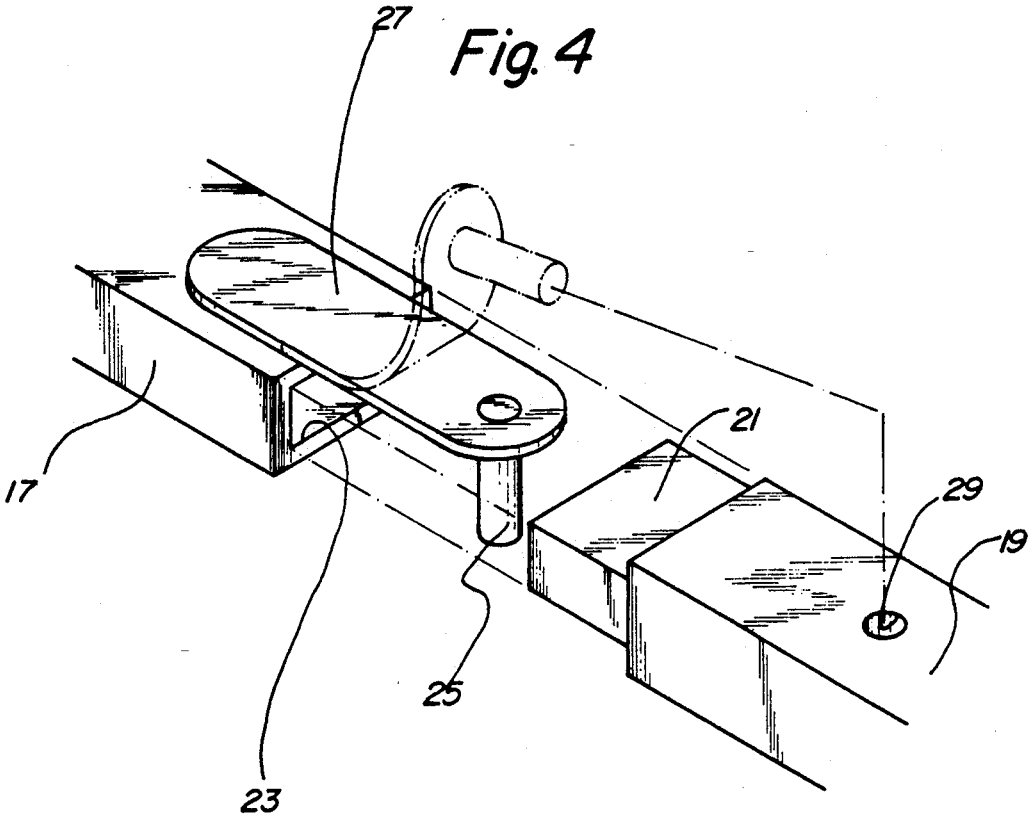

HOCKEY TRAINING APPARATUS

BACKGROUND OF THE INVENTION

1. Field of the Invention

The present invention relates generally to sports training aids and game apparatuses and more particularly, to a hockey training aid and game apparatus.

2. Description of the Prior Art

Hockey training aids and/or game apparatuses are well known in the art as exemplified by the following U.S. Pat. Nos. 3,709,489 of Holleran et al; 3,912,269 of Barlow; 3,970,306 of Smith; 4,105,210 of Jones et al; and 4,560,163 of Erickson.

The device in the Holleran et al patent is very large and not easily transported. The device in the Barlow patent is small and easily transported, but it does not include a life-size hockey stick. Similarly, the device in the Smith patent does not include a hockey stick. The device in the Jones et al patent does not have means for measuring accuracy in puck shooting. The device in the Erickson patent is very large and not easily transported and does not have means for measuring accuracy in puck shooting.

Moreover, the prior art hockey training aids and/or game apparatuses do not provide means for measuring both inaccurate shots and accurate shots. In addition, the prior art devices generally require the presence of two or more competitors. It would be desirable, however, if a device were provided which enabled a person working alone to improve the person's puck shooting skills.

Thus, while the foregoing body of prior art indicates it to be well known to use hockey training and/or game devices, the provision of a simple, portable, and cost effective device is not contemplated. The prior art does not provide does not hockey training devices that include means for measuring accuracy in puck shooting. In addition, the prior art does not provide hockey training devices with means for measuring both inaccurate shots and accurate shots. The prior art does not provide a device which enables a person working alone to improve the person's puck shooting skills. The foregoing disadvantages are overcome by the unique hockey training aid and game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved hockey training aid and game apparatus which includes a portable housing which includes a base unit and a cover connected to the base unit. The base unit includes a floor and four side walls connected to the floor. The floor contains indicia representing a hockey rink; and the cover includes brackets for retaining a collapsible hockey stick when apparatus is transported. The stick is capable of being assembled into a functional hockey stick when the hockey training aid and game apparatus of the invention is used. A first sensor assembly is used for monitoring accurate puck handling. A scoring and control assembly is provided for scoring puck handling and includes a first counter assembly, connected to the first sensor assembly, for counting monitored instances of accurate puck handling sensed by the first sensor assembly. A timer shuts off the first counter assembly after a predetermined time expires.

A second sensor assembly may be employed for monitoring inaccurate puck handling. In this respect, the scoring and control assembly further includes a second counter assembly, connected to the second sensor assembly, for counting monitored instances of inaccurate puck handling sensed by the second sensor assembly. The second counter assembly is also shut off by the timer after a predetermined time expires. A sounding device, controlled by the second sensor assembly, can sound when inaccurate puck handling is sensed by the second sensor assembly.

The first sensor assembly, for measuring puck handling accuracy, includes a first puck sensor located in a center of the floor. The second sensor assembly, for measuring puck handling inaccurancy, includes a number of second puck sensors, or a ribbon of sensors, located along lines near side walls in the floor. Both the first puck sensor and the second puck sensor are responsive to magnetic flux, and the puck includes a permanent magnet.

The side walls include resilient bumpers. The cover includes brackets for retaining the scoring and control assembly thereon when the apparatus is transported. One of the walls includes connectors for securing the scoring and control assembly thereon when the apparatus is being used.

The puck may include a hollow puck housing and an interior chamber defined by the puck housing. A filler hole is provided in a wall of the puck housing for admitting a quantity of lubricant powder into the interior chamber. The filler hole has a cover. A plurality of weep holes are located in a bottom wall of the puck housing for permitting lubricant powder to pass from the interior chamber to a bottom outer surface of the puck housing for lubricating motion of the puck along the floor. A quantity of permanent magnetic material is retained in a bottom wall of the puck housing.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved hockey training aid and game apparatus which has all of the advantages of the prior art and none of the disadvantages.

It is another object of the present invention to provide a new and improved hockey training aid and game apparatus which may be easily and efficiently manufactured and marketed.

It is a further object of the present invention to provide a new and improved hockey training aid and game apparatus which is of durable and reliable construction.

An ever further object of the present invention is to provide a new and improved hockey training aid and game apparatus which is susceptible of a low cost of manufacture with regard to both materials and labor, and which accordingly is then susceptible of low prices of sale to the consuming public, thereby making such hockey training aid and game apparatus available to the buying public.

Still yet a further object of the present invention is to provide a new and improved hockey training aid and game apparatus that is small and easily transported.

Still another object of the present invention is to provide a new and improved hockey training aid and game apparatus that is small and easily transported and that includes a life-size hockey stick.

Yet another object of the present invention is to provide a new and improved hockey training aid and game apparatus that includes means for measuring accuracy in puck shooting.

Even another object of the present invention is to provide a new and improved hockey training aid and game apparatus that includes means for measuring both inaccurate shots and accurate shots.

Still a further object of the present invention is to provide a new and improved hockey training aid and game apparatus which enables a person working alone to improve the person's puck shooting skills.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged cross-sectional view of the hockey training aid and game apparatus of FIG. 2 taken along line 3—3 thereof.

FIG. 4 is an enlarged view of the circled region 4 shown in FIG. 2, showing a connector for assembling the collapsible hockey stick.

DESCRIPTION OF THE PREFERRED EMBODIMENT

With reference to the drawings, a new and improved hockey training aid and game apparatus embodying the principles and concepts of the present invention will be described.

Figure 1:
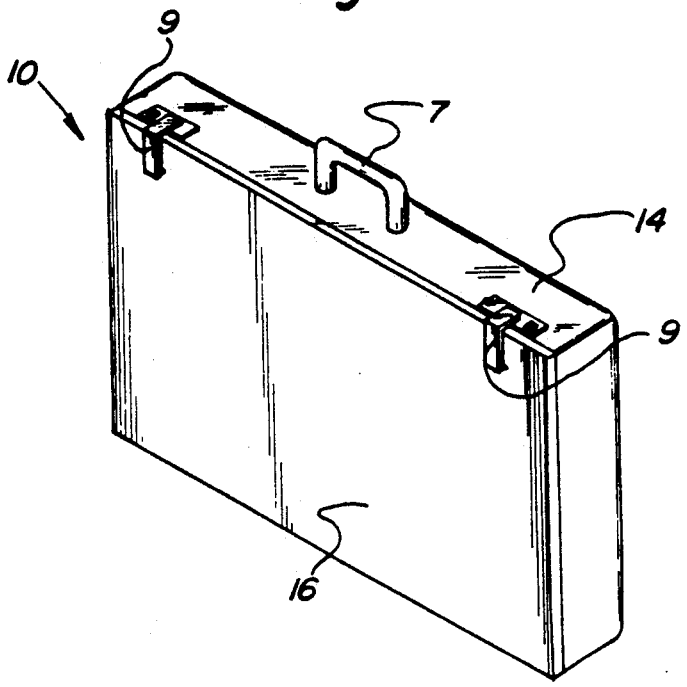
FIG. 1 is a perspective view showing a first preferred embodiment of the hockey training aid and game apparatus of the invention in a folded up condition suitable for transport.

Turning initially to FIGS. 1–7, there is shown a first exemplary embodiment of the hockey training aid and game apparatus of the invention generally designated by reference numeral 10. In its preferred form, hockey training aid and game apparatus 10 includes a portable housing 12 which includes a base unit 14 and a cover 16 connected to the base unit 14. In FIG. 1, the hockey training aid and game apparatus 10 of the invention is shown in a closed arrangement with the cover 16 fastened to the base unit 14 by locking clasps 9. A handle 7 is provided for ease of carrying the portable apparatus 10.

Figure 2:
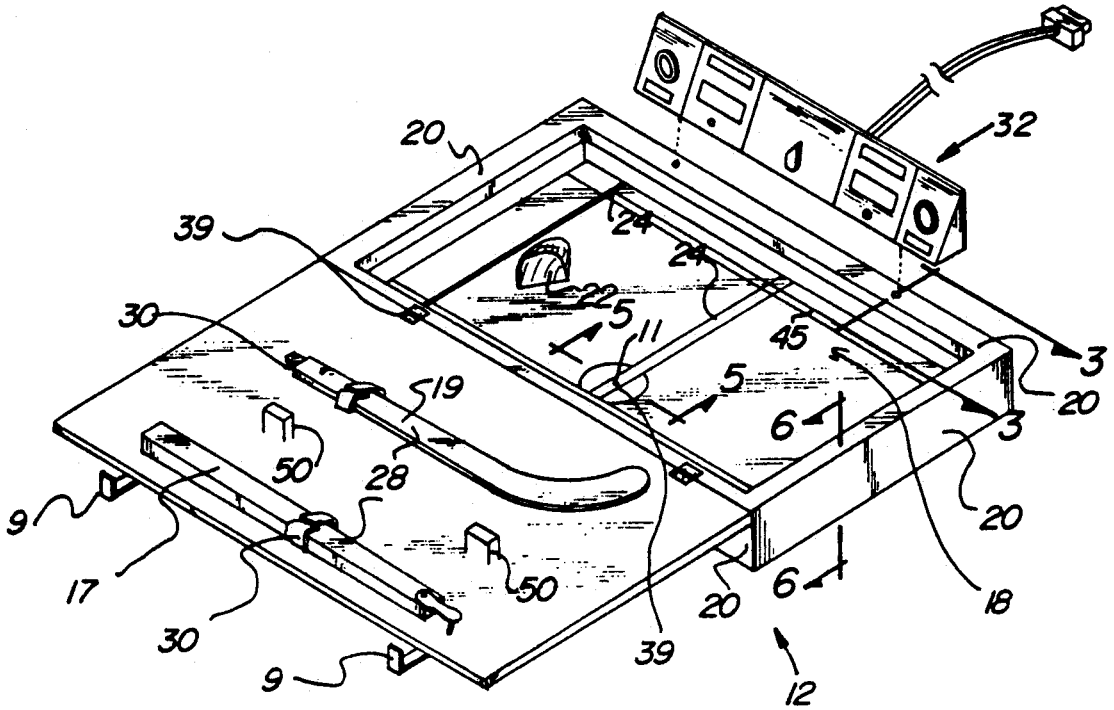
FIG. 2 is a perspective view of the hockey training aid and game apparatus shown in FIG. 1 in a partially assembled condition wherein the scoring and control assembly is about to be placed on a wall of the housing, and wherein the collapsible hockey stick has not yet been assembled.

As shown in FIG. 2, the base unit 14 includes a floor 18 and four side walls 20 connected to the floor 18. FIG. 2 shows the apparatus of the invention in an open arrangement in preparation for using. The floor 18 contains indicia 24 representing a hockey rink. For example, the indicia 24 can include a center red line, blue lines, etc.. The cover 16 includes first brackets 30 for retaining a collapsible stick 28 in a collapsed condition when the hockey training aid and game apparatus 10 is transported. A puck 22 is shown resting on the floor 18.

As shown in FIG. 4, the stick 28 is capable of being assembled into a functional hockey stick when the hockey training aid and game apparatus 10 of the invention is used. More specifically, handle element 17 is connected to puck-hitting element 19 using a male element 21 which fits into a complementary female recess 23. To lock the handle element 17 and the puck-hitting element 19 together once the male element 21 is inserted into the female recess 23, a pin 25, located at one end of flexible strip 27 retained on handle element 17, is inserted into hole 29 on puck-hitting element 19.

Figure 5:
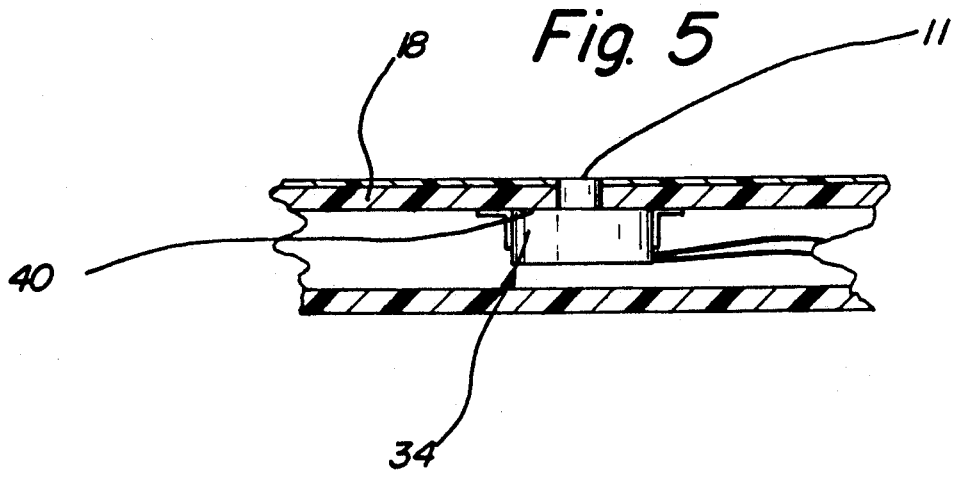
FIG. 5 is an enlarged cross-sectional view of the floor of the embodiment of the invention shown in FIG. 2 taken along line 5—5 of FIG. 2.

A first sensor assembly 34, for monitoring accurate puck handling, is shown in FIG. 5 and is located under the center 11 of the floor 18. A scoring and control assembly 32, for scoring puck handling, is placed onto wall 20 when the hockey training aid and game apparatus 10 is used. More specifically, as shown in FIG. 3, nipples 13 project from the bottom of the scoring and control assembly 32, and the nipples 13 fit into rubber grommets 15 located in the wall 20, whereby the scoring and control assembly 32 is secured onto the wall 20.

Figure 6:
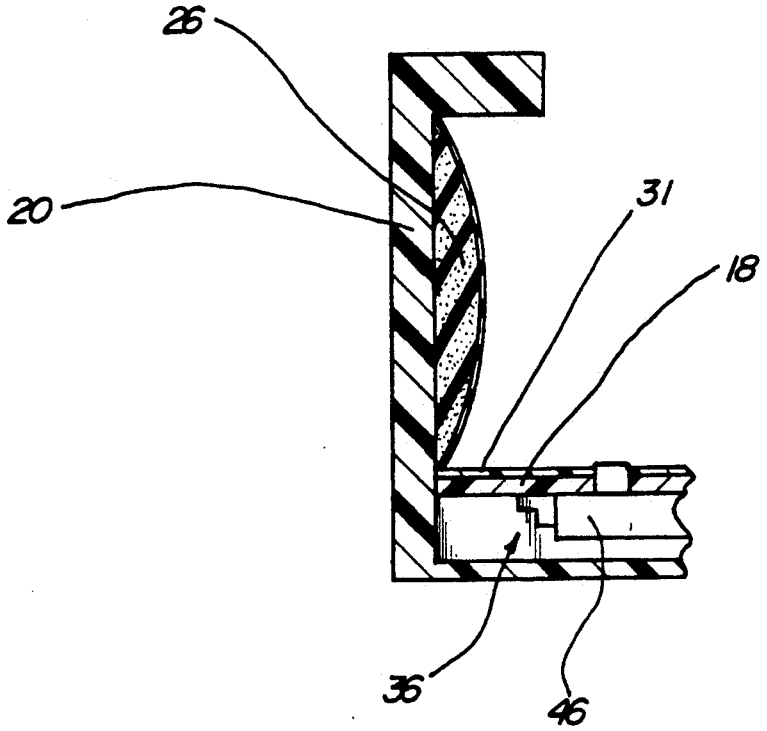
FIG. 6 is an enlarged cross-sectional view of the wall of the embodiment of the invention shown in FIG. 2 taken along line 6—6 of FIG. 2.

As shown in FIG. 6, the side walls 20 include resilient bumpers 26 which may be made from an inexpensive, resilient foam rubber. In addition, the floor 18 can include a slippery surface layer 31, such as one made from a polytetrafluoroethylene polymer such as Teflon (TM).

As shown in FIG. 2, the cover 16 includes second brackets 50 for retaining the scoring and control assembly 32, using complementary connectors thereon (not shown) when the hockey training aid and game apparatus 10 is transported. The cover 16 is connected to the wall 20 by means of hinges 39.

Figure 7:
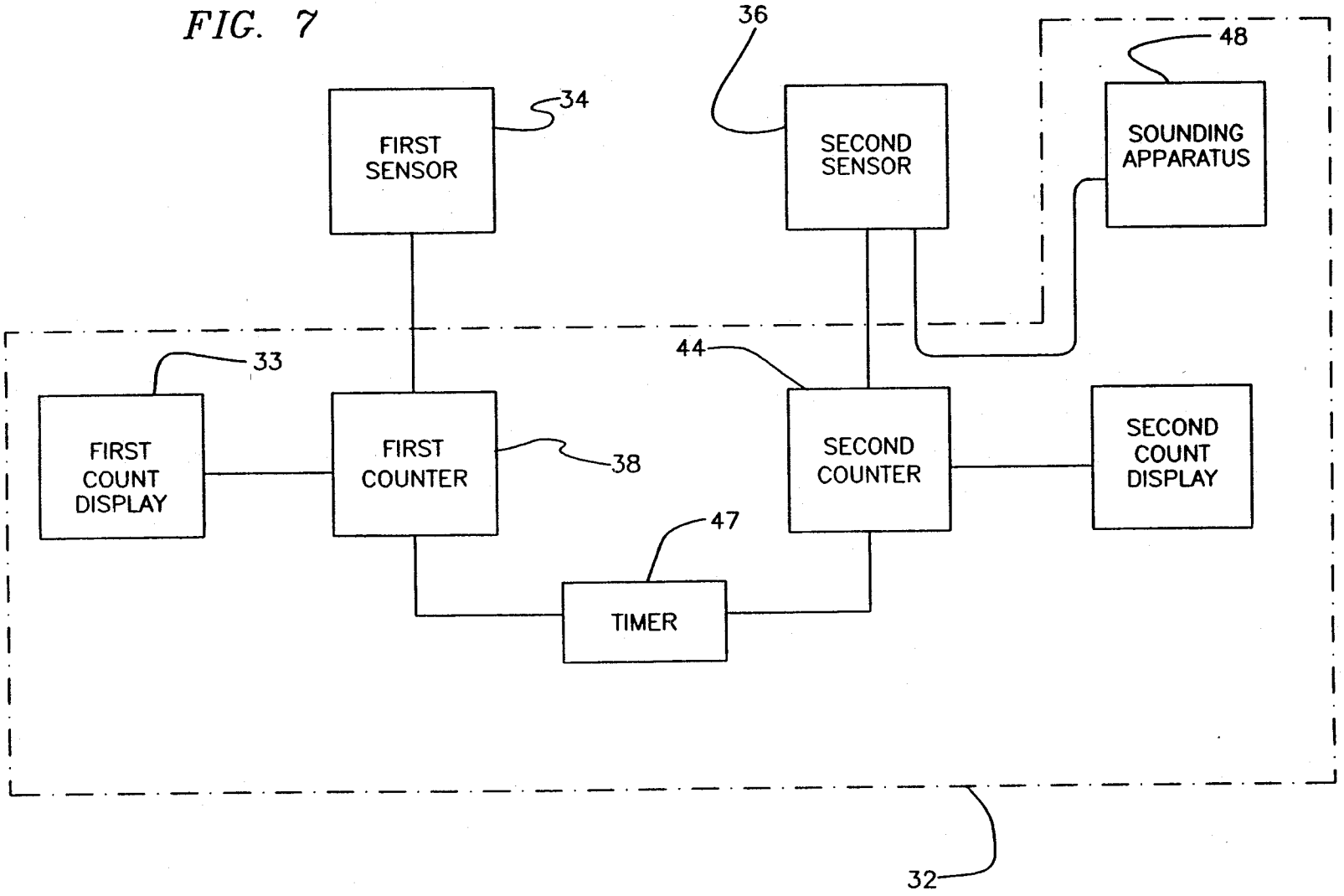
FIG. 7 is a block diagram of circuit assemblies used with the embodiment of the hockey training aid and game apparatus of the invention shown in FIG. 2.

Turning to the schematic block diagram in FIG. 7, the first counter assembly 38 is connected to the first sensor assembly 34, for counting monitored instances of accurate puck handling sensed by the first sensor assembly 34. Timer 47 permits the first counter assembly 38 to run and shuts it off after a predetermined time expires. The first counter assembly 38 is also connected to a first count display unit 33 which the count of accurate puck handling. The scoring and control assembly 32, shown as the components contained within the dashed box, further includes the second sensor assembly 36 which monitors inaccurate puck handling. A second counter assembly 44 is connected to the second sensor assembly 36 and counts monitored instances of inaccurate puck handling sensed by the second sensor assembly 36. Moreover, the second counter assembly 44 is also shut off by the timer 47 after the predetermined time expires.

The scoring and control assembly 32 also includes a sounding device 48, such as a simple buzzer, controlled by the second sensor assembly 36, for sounding when inaccurate puck handling is sensed by the second sensor assembly 36.

As shown in FIG. 5, the first sensor assembly 34 includes a first puck sensor 40 located in a center of the floor 18. As shown in FIG. 6, the second sensor assembly 36 includes a second puck sensor 46 located near a side wall 20 in the floor 18. Either a plurality of second puck sensors 46 or a ribbon of sensors can be arrayed along lines 45 (see FIG. 2) near side walls 20 in the floor 18.

Preferably, the first puck sensor 40 and the second puck sensors 46 are responsive to magnetic flux. In this respect, they can be conventional sensors that depend upon the Hall effect. The puck 22 includes a permanent magnet 35 (see FIG. 10).

All of the electronic components shown in block form in FIG. 7 can be implemented by conventional electronic components, especially using integrated circuits for counter, displays, and timers. The first and second sensors can be implemented by Hall effect sensors which respond to a change in magnetic flux that occurs when a magnet-containing puck moves past a Hall effect sensor.

Figure 8:
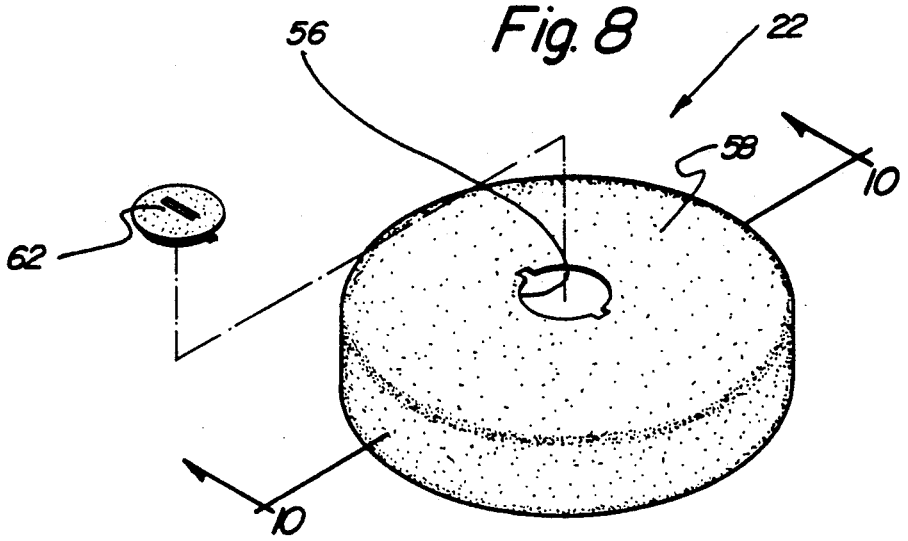
FIG. 8 is a perspective view of a second embodiment of a puck used with the hockey training aid and game apparatus of the invention.
Figure 9:
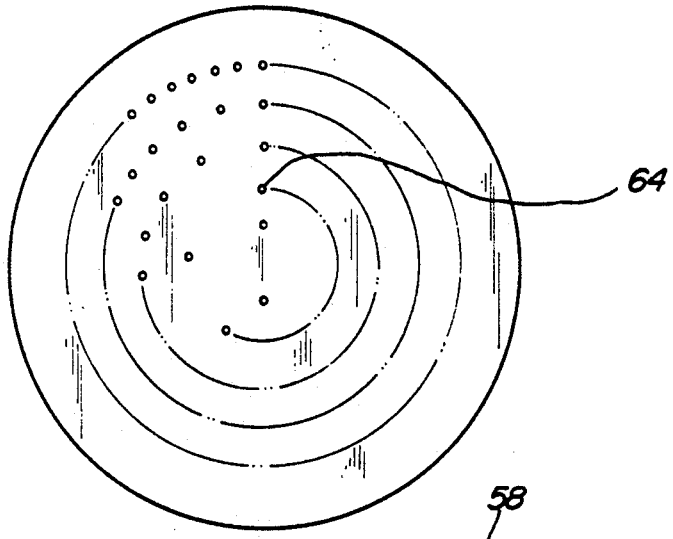
FIG. 9 is a bottom view of the embodiment of the puck shown in FIG. 8.
Figure 10:
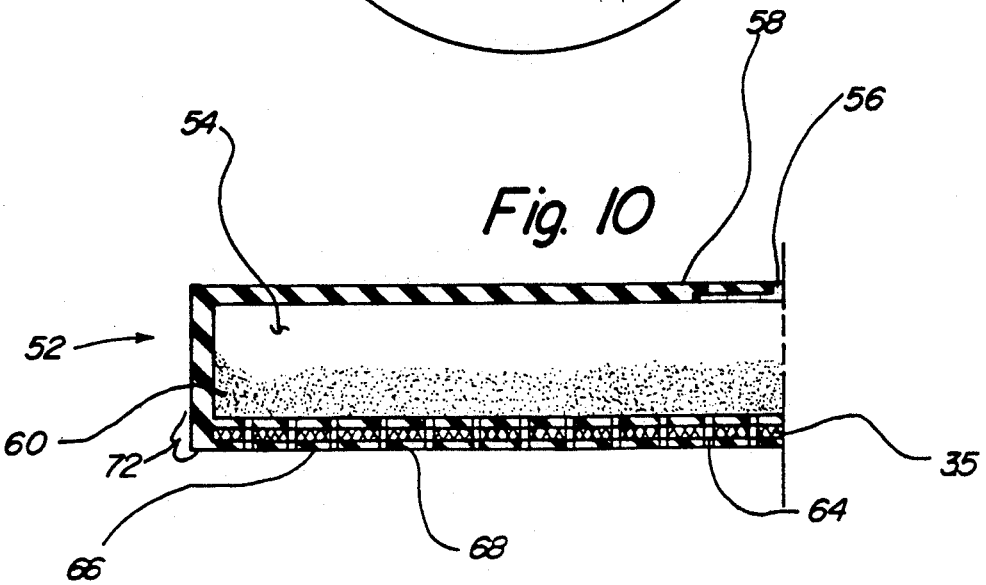
FIG. 10 is a partial cross-sectional view of the embodiment of the puck shown in FIG. 8 taken along the line 10—10 thereof.

Turning to FIGS. 8-10, a second embodiment of a puck 22 used in the hockey training aid and game apparatus 10 of the invention is shown. Reference numerals are shown that correspond to like reference numerals that designate like elements shown in the other figures. In addition, the puck 22 includes a hollow puck housing 52 having an interior chamber 54 defined by the puck housing 52. A filler hole 56 is located in a wall 58 of the puck housing 52 and is used for admitting a quantity of lubricant powder 60, such as talcum powder, into the interior chamber 54. A filler hole cover 62 is used for covering the filler hole 56. A plurality of weep holes 64 are located in a bottom wall 66 of the puck housing 52 for permitting lubricant powder 60 to pass from the interior chamber 54 to a bottom outer surface 68 of the puck housing 52. A quantity of permanent magnetic material 35 is retained in a bottom wall 72 of the puck housing 52.

The structural components of the invention can be made from inexpensive materials such as plastics. The collapsible hockey stick can be made from wood, if desired.

In using the hockey training aid and game apparatus 10 of the invention, every time a player moves the puck 22 across the first sensor assembly 34, the first counter 38 will add an additional increment to its cumulative total. The first counter 38 will continue to add increments until the time runs out; that is the timer 47 turns off. The cumulative total can be the player's score.

To beat one player's score, another player would be forced to handle the stick 28 faster. In this respect, a player can also try to beat his previous score.

However, if a player loses control of the puck 22, it would slide either to the left or right. If the puck 22 then crosses the blue line, the second sensor assembly 36 would sense this, and two results will take place: a sounding device (such as a buzzer or a bell) will sound; and the second counter 44 will be incremented by one unit. After the timer 47 runs out of its predetermined time, a final score can be determined by subtracting the total from the second counter 44 from the first counter 38.

A novice player, the player can look down on the puck when playing, and as his score would improve, the player's puck handling skills would also improve. To further improve stick handling skills, a player can stike the puck without looking at the puck. This would be an increased challenge.

To further improve on stick handling skills, a left handed player can stand with the left side of his body facing the apparatus and handle the stick in that fashion. Conversely, a right handed player can stand with the right side of his body facing the apparatus and handle the stick in that fashion.

The score board can be from 0-100 points, and the player who reaches 100 points first would be the winner of the game one. There can be a three game format. To register the score, a sliding register device can be employed.

The hockey training aid and game apparatus of the invention provides excellent off ice training for all players. Using the apparatus can improve hand and eye coordination and increase a player's skill either to pass a puck to team mates with ease and accuracy or to receive a pass with greater ease.

With the invention, a player can get stick handling practice and improve puck shooting accuracy without undergoing collisions with opponents and without risking serious injury.

The invention is portable and can be used virtually anywhere. For example, the apparatus can be used in a dressing room prior to a game or practice as a warm up. The apparatus can be used by amateurs, by professionals, by men, by women, and by children. The apparatus can be used in the off season in homes or at playgrounds.

By a person keeping his stick handling and puck shooting skills at a high level of performance, the player can impress oneself, team mates, coaches, managers, parents, friends, fans, other teams, and scouts.

It is apparent from the above that the present invention accomplishes all of the objects set forth by providing a new and improved hockey training aid and game apparatus that is low in cost, relatively simple in design and operation, and which may advantageously be used as an easily transported hockey training aid and game apparatus that includes a life-size hockey stick, that provides means for measuring both inaccurate shots and accurate shots, and that enables a person working alone to improve the person's puck shooting skills.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved hockey training aid and game apparatus, comprising:

a portable housing which includes a base unit and a cover connected to said base unit, wherein said base unit includes a floor and four side walls connected to said floor, wherein said floor contains indicia representing a hockey rink, and wherein said cover includes means for retaining a collapsible stick, a collapsible stick retained by said stick retaining means in a collapsed condition when said hockey training aid and game apparatus is transported, said stick being capable of being assembled into a functional hockey stick when said hockey training aid and game apparatus is used, a puck, a first sensor assembly means for monitoring accurate puck handling, and a scoring and control assembly means for scoring puck handling, which includes a first counter assembly means, connected to said first sensor assembly means, for counting monitored instances of accurate puck handling sensed by said first sensor assembly means, and a timer means for shutting off said first counter assembly means after a predetermined time expires.

2. The apparatus described in claim 1 wherein said side walls include resilient bumpers.

3. The apparatus described in claim 1 wherein said cover includes means for retaining said scoring and control assembly means thereon when said hockey training aid and game apparatus is transported.

4. The apparatus described in claim 1 wherein one of said walls includes means for securing said scoring and control assembly means when said hockey training aid and game apparatus is being used.

5. The apparatus described in claim 1, further including a second sensor assembly means for monitoring inaccurate puck handling, and wherein said scoring and control assembly means further includes:

a second counter assembly means, connected to said second sensor assembly means, for counting monitored instances of inaccurate puck handling sensed by said second sensor assembly means, and wherein said second counter assembly means is shut off by said timer means after a predetermined time expires.

6. The apparatus described in claim 5, further including sounding means, controlled by said second sensor assembly means, for sounding when inaccurate puck handling is sensed by said second sensor assembly means.

7. The apparatus described in claim 5 wherein said second sensor assembly means includes a second puck sensor located near a side wall in said floor.

8. The apparatus described in claim 7 wherein:

said second puck sensor is responsive to magnetic flux, and said puck includes a permanent magnet.

9. The apparatus described in claim 1 wherein said first sensor assembly means includes a first puck sensor located in a center of said floor.

10. The apparatus described in claim 9 wherein:

said first puck sensor is responsive to magnetic flux, and said puck includes a permanent magnet.

11. The apparatus described in claim 1 wherein said puck includes:

a hollow puck housing, an interior chamber defined by said puck housing, a filler hole in a wall of said puck housing for admitting a quantity of lubricant powder into said interior chamber, a filler hole cover for covering said filler hole, a plurality of weep holes located in a bottom wall of said puck housing for permitting lubricant powder to pass from said interior chamber to a bottom outer surface of said puck housing, and a quantity of permanent magnetic material retained in a bottom wall of said puck housing.

* * * * *